US009228811B2

(12) United States Patent
Besson

(10) Patent No.: US 9,228,811 B2
(45) Date of Patent: Jan. 5, 2016

(54) GAS GENERATOR PROVIDED WITH A SAFETY DEVICE FOR SLOW WARM-UPS

(71) Applicant: HERAKLES, Le Haillan (FR)

(72) Inventor: Jean-Marc Besson, Bordeaux (FR)

(73) Assignee: HERAKLES, Le Haillan (FR)

( * ) Notice: Subject to any disclaimer, the term of this patent is extended or adjusted under 35 U.S.C. 154(b) by 105 days.

(21) Appl. No.: 14/352,214

(22) PCT Filed: Oct. 1, 2012

(86) PCT No.: PCT/FR2012/052215

§ 371 (c)(1),
(2) Date: Apr. 16, 2014

(87) PCT Pub. No.: WO2013/057404

PCT Pub. Date: Apr. 25, 2013

(65) Prior Publication Data

US 2014/0338553 A1 Nov. 20, 2014

(30) Foreign Application Priority Data

Oct. 17, 2011 (FR) ..... 11 59344

(51) Int. Cl.
*F42C 15/28* (2006.01)
*F42B 3/04* (2006.01)
(Continued)

(52) U.S. Cl.
CPC . *F42B 3/04* (2013.01); *F42B 3/006* (2013.01); *F42B 39/20* (2013.01)

(58) Field of Classification Search
CPC ..... B60R 21/2644; B60R 2021/2648; B60R 21/264; B60R 21/26; B60R 21/261; B60R 21/276; B60R 2021/26029; B60R 2021/2612; F42B 3/04
USPC ..... 102/530, 202.1, 222, 223; 280/736, 737
See application file for complete search history.

(56) References Cited

U.S. PATENT DOCUMENTS 4,454,816 A * 6/1984 Billard ..... F42C 15/184 102/223
4,683,823 A * 8/1987 Dinger ..... F42C 15/18 102/229

(Continued)

FOREIGN PATENT DOCUMENTS

DE 102005022760 11/2006
EP 1496268 1/2005

(Continued)

*Primary Examiner* — Benjamin P Lee
(74) *Attorney, Agent, or Firm* — Hamre, Schumann, Mueller & Larson P.C.

(57) ABSTRACT

The present invention relates to a gas generator (10) comprising a body (12) delimiting at least one part of a combustion chamber (20), said part housing a primary pyrotechnic charge (16) adapted to generate gases in the combustion chamber (20) when said charge is initiated in combustion, and a slide valve (60) located outside said body (12) and defining with the latter a second chamber (66) housing a secondary pyrotechnic charge (74) whereof the self-ignition temperature is less than that of the primary pyrotechnic charge (16). A gas flow channel (50) for flowing gas out of the combustion chamber (20) is formed in the body (12). According to the invention, the slide valve (60) blocks this channel when it is in a first position, and under the effect of gases released by said secondary pyrotechnic charge (74), the slide valve is adapted to move to a second position wherein the channel (50) is no longer sealed off, allowing the gases contained in the combustion chamber (20) to flow outwards to the exterior.

11 Claims, 1 Drawing Sheet

(51) Int. Cl.
*F42B 3/00* (2006.01)
*F42B 39/20* (2006.01)

(56) References Cited

U.S. PATENT DOCUMENTS 4,709,637 A * 12/1987 Boggero ..... F42C 15/36 102/378
4,714,020 A * 12/1987 Hertsgaard ..... F42B 3/04 102/275.11
4,991,513 A * 2/1991 Malamas ..... F42C 19/02 102/293
5,159,150 A * 10/1992 Wardecki ..... F42C 15/005 102/226
5,380,039 A 1/1995 Emery et al.
6,213,502 B1 * 4/2001 Ryan ..... B60R 21/276 280/736
7,025,000 B1 * 4/2006 Wong ..... F42C 15/00 102/481
7,059,458 B2 * 6/2006 Borg ..... B60R 21/38 188/371
7,296,504 B2 * 11/2007 Borg ..... B60R 21/34 102/254
7,444,937 B2 * 11/2008 Magnan ..... F42C 15/34 102/221
7,490,553 B2 * 2/2009 Magnan ..... F42C 15/184 102/222
7,520,531 B2 * 4/2009 Gammill ..... B60R 21/276 102/530
7,695,010 B2 * 4/2010 Perez ..... B60R 21/268 280/737
7,950,691 B1 5/2011 Mayville
8,029,630 B2 10/2011 Marlin et al.
8,967,046 B2 * 3/2015 Dunaway ..... F42B 3/04 102/202
2001/0045734 A1 * 11/2001 Damman ..... B60R 21/276 280/736
2003/0010246 A1 1/2003 Bonnel et al.
2005/0016371 A1 1/2005 Borg et al.
2006/0261583 A1 11/2006 Debler et al.
2007/0131127 A1 * 6/2007 Magnan ..... F42C 15/184 102/222
2011/0297033 A1 * 12/2011 Gaisbauer ..... F41J 2/02 102/481

FOREIGN PATENT DOCUMENTS

FR 2827376 1/2003
FR 2870234 11/2005

* cited by examiner

GAS GENERATOR PROVIDED WITH A SAFETY DEVICE FOR SLOW WARM-UPS

The invention relates to a gas generator, and more particularly a gas generator comprising a body delimiting at least a part of a combustion chamber, said part housing a primary pyrotechnic charge adapted to generate gases in the combustion chamber when said charge is initiated in combustion.

The gas generator according to the present invention is adapted particularly to be integrated into an ejection device of a payload, especially a beacon or a lure, or in a cylinder.

More generally, throughout the present application, « device to be actuated» shall designate a device into which the gas generator according to the invention can be integrated.

Because of the initiation of its primary pyrotechnic charge, a gas generator of the above type quickly generates a considerable quantity of gas inside the combustion chamber. The pressure of gases inside this chamber can then cause actuation of the device to be actuated, especially displacement of a piston.

With an unexpected rise in temperature, caused for example by a fire, the primary pyrotechnic charge of the generator can ignite prematurely by auto-ignition. It can then react violently, burn abnormally and even explode, putting nearby people in danger.

To prevent this untimely and uncontrolled function of the gas generator, in the past it was envisaged to integrate therein a thermal fuse having a self-ignition temperature less than that of the main charge, enabling firing of the main charge before the latter reaches its self-ignition temperature. Such a solution, described especially in patent application FR 2 870 234, has a number of disadvantages. First of all, the primary pyrotechnic charge is always initiated in the event of abnormal heating, even if the temperature has not reached its self-ignition temperature. Also, the device is always effectively triggered, even in the event of fire, which can endanger people located nearby and possibly cause a loss of payload which can be at a high cost.

According to another application FR 2 827 376, the primary pyrotechnic charge of a munition is combined with a block of pyrotechnic material forming a safety igniter adapted, in the event of slow heating, to generate combustion of the main charge without detonation.

The aim of the invention is to provide a gas generator of the above type which, in the event of abnormal heating, prevents untimely initiation of the primary pyrotechnic charge when the self-ignition temperature of said charge has not been reached and prevents operation of the device to be actuated.

This aim is attained by means of a gas generator comprising a body delimiting at least a part of a combustion chamber, said part housing a primary pyrotechnic charge adapted to generate gases in the combustion chamber when said charge is initiated in combustion, and characterised in that it also comprises a slide valve located outside said body and defining with the latter a second chamber housing a secondary pyrotechnic charge whereof the self-ignition temperature is less than that of the primary pyrotechnic charge, in that a gas flow channel for flowing gas out of the combustion chamber is formed in the body, in that the slide valve blocks the gas flow channel when it is in a first position, and in that under the effect of gas released by said secondary pyrotechnic charge the slide valve is adapted to move to a second position wherein said channel is no longer sealed off, allowing gas contained in the combustion chamber to flow outwards to the exterior.

During normal operation, the gas generator according to the invention works as follows: under the effect of one or more pyrotechnic initiators, the combustion of the main charge is initiated. Gases originating from combustion are released very rapidly in the combustion chamber. Under the effect of pressure, these gases actuate the device housing generator, for example by causing movement of a piston communicating with the combustion chamber. During normal operation, the secondary pyrotechnic charge housed in the second chamber is not initiated. It does not ignite, such that no gas is released in the second chamber. Because of this, the slide valve remains in its first position, wherein it blocks the gas flow channel for flowing gas out of the combustion chamber. Because the gas is unable to escape from the combustion chamber, it rises very quickly in pressure and causes sudden and efficacious actuation of the device to be actuated.

It is pointed out, according to the invention, that the self-ignition temperature of the secondary pyrotechnic charge is less than that of the primary pyrotechnic charge.

When the gas generator is subjected to a rise in temperature, especially in the event of fire, the pyrotechnic material contained in the second chamber between the slide valve and the body will therefore initiate first. It acts as thermal fuse or safety member, as follows:

During its combustion, the secondary pyrotechnic charge will progressively release gas, pressurising the second chamber. Under the effect of this pressure, the slide valve will move from its first position described hereinabove to a second position, wherein the gas flow channel for flowing gas out of the combustion chamber is open (i.e. no longer sealed off by the slide valve).

In this position, in the event of initiation of the primary pyrotechnic charge under the effect of the rise in temperature, the gas flow channel prevents the pressure inside the combustion chamber from reaching the pressure threshold beyond which the device is actuated (for example the pressure threshold beyond which a piston of the device is moved). This ensures that in the event of fire, or in all other cases of unforeseen heating, the device to be actuated is not started up, even if the temperature exceeds the self-ignition temperature of the primary pyrotechnic charge.

Also, in the gas generator according to the invention the secondary pyrotechnic charge forming a thermal fuse can be easily replaced. During maintenance operations the slide valve is easily detached from the body of the generator.

According to an embodiment, the slide valve is capable of moving by sliding along a rectilinear trajectory.

According to another example, the slide valve could be capable of moving by pivoting about the axis of the body of the generator.

According to an example, the slide valve is coaxial to the body.

According to an example, the body comprises at least one first section having a first diameter and a second section of greater diameter located in the extension of the first, a shoulder being defined between the first and the second section, and the slide valve comprises a first part adapted to slide along the second section and a second part extending radially towards the interior and whereof the internal radial face is adapted to slide along the first section, the second chamber being defined between the shoulder and the second part of the slide valve.

According to another example, the gas flow channel comprises a plurality of holes distributed over the entire periphery of the body.

According to another example, the slide valve comprises at least one opening adapted to communicate with the gas flow channel when the slide valve is in its second position, the gas contained in the combustion chamber then able to flow towards the exterior via said flow channel and said opening.

The opening comprises for example a plurality of holes distributed over the circumference of the slide valve, each terminating on the external face and on the internal face of the slide valve.

In this case, if the gas flow channel comprises corresponding through holes formed in the thickness of the generator body, it is necessary for gas flow to ensure proper alignment of the holes of the slide valve and those of the body. To ensure flow of gas without excessive precision in the relative positioning of the two elements being necessary, it is possible to have the opening of the slide valve comprise a circumferential groove formed on its internal face and at least one hole terminating in said groove and on the external face of said slide valve, said groove delimiting an annular chamber with the body when the slide valve is in its first position and being adapted to communicate with the gas flow channel when the slide valve is in its second position. According to a variant, the gas flow channel comprises a circumferential groove formed on the external face of the body and at least one hole terminating in said groove and on the internal face of said body, said groove delimiting an annular chamber with the slide valve when the latter is in its first position and being adapted to communicate with its opening when the slide valve is in its second position. It is also possible for the slide valve and the body to both comprise circumferential grooves such as defined previously.

The present invention also relates to a device comprising a gas generator such as defined previously, wherein the gases emitted by the primary pyrotechnic charge of the gas generator when it is initiated in combustion are adapted to actuate said device. The device is therefore adapted to be actuated under the effect of the pressure generated by the gas put out by the generator. This device to be actuated can for example comprise an ejection device of a payload or a cylinder.

Other characteristics and advantages of the invention will emerge from the following description of embodiments of the invention given by way of illustration and non-limiting. This description makes reference to the attached pages of drawings, wherein.

Figure 1:
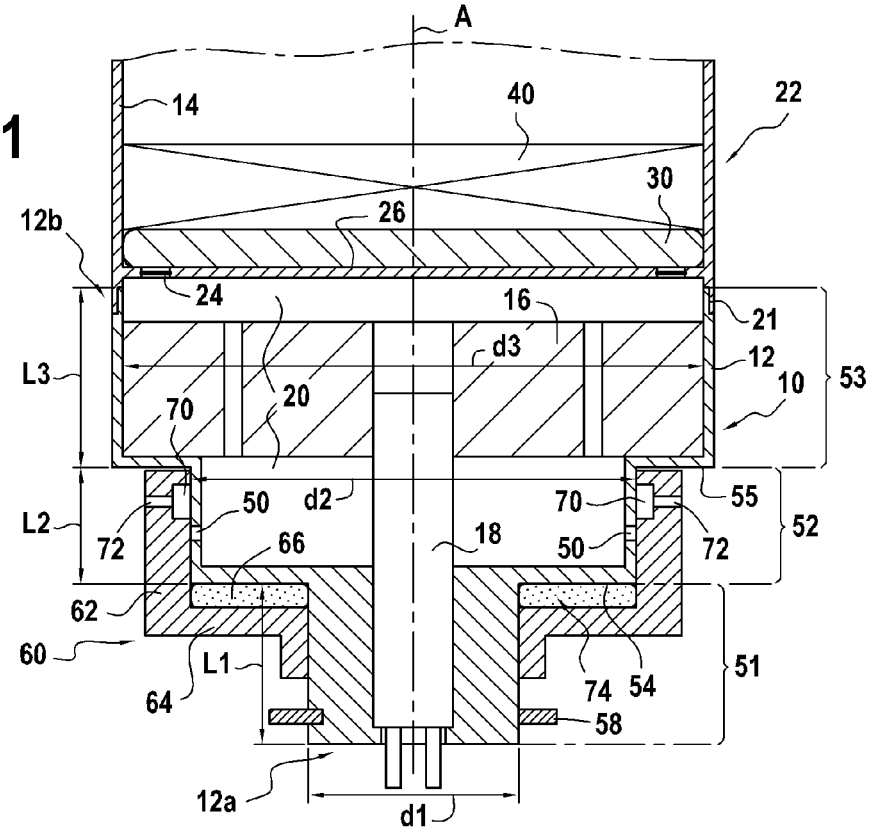
FIG. 1 shows a partial view, in axial section, of a gas generator according to an embodiment of the present invention, before heating.

The gas generator 10 such as illustrated in FIG. 1 is intended to be integrated into an ejection payload device 22 to be described in more detail hereinbelow.

The gas generator 10 comprises a body 12, overall cylindrical of axis A in the example illustrated, and open at one of its axial ends 12*b* (hereinafter free end).

The body 12 houses a primary pyrotechnic charge 16 and a pyrotechnic initiator 18 to ignite said charge 16.

As illustrated in FIG. 1, a plurality of holes 50, whereof the function will be described in more detail hereinbelow, is formed in the body 12.

In the example, the body 12 comprises, from its upstream end 12*a* to its free end 12*b*, a succession of sections 51, 52, 53 of increasing diameters, forming projections or bearings 54, 55.

In FIG. 1, the body 12 comprises a first section 51 of diameter d1 and axial length L1. Downstream from this first section 51, the body 12 comprises a second section 52 of diameter d2 greater than d1 and of length L2, and downstream from this second section 52, a third section 53 of diameter d3 greater than d2 and length L3. A first and a second shoulder 54, 55 are defined respectively between the first and the second section 51, 52 and between the second and the third section 52, 53.

Apart from the above elements, the gas generator 10 comprises a slide valve 60 enclosing the body 12. In the example, the slide valve 60 is coaxial to the body 12 and capable of sliding rectilinearly along said body 12, according to the direction of the axis A.

The body 12 and the slide valve 60 of the gas generator 10 can, for example, be arranged as follows:

The slide valve 60 has a general annular form. It comprises a first portion 62 extending axially, capable of sliding along a section 52 of the body 12 (here the second section), and a second portion 64 extending radially towards the interior from one end of the first portion 62 and facing a radial portion adjacent to the body 12 (here the first shoulder 54) and delimiting therewith a safety chamber or second chamber 66.

For this, in the example, when the downstream end of the first portion 62 of the slide valve 60 is leaning against the second shoulder 55 of the body 12 minimum spacing is kept between the first shoulder 54 and the second portion 64 of the slide valve 60.

The first portion 62 of the slide valve 60 comprises, on its internal face, a circumferential groove 70 defining with the body 12 an annular chamber. It also comprises at least one escape hole 72, preferably a plurality of holes 72, extending from this circumferential groove 70 and terminating on the external face of the slide valve 60.

The safety chamber 66 houses pyrotechnic material 74, forming a secondary pyrotechnic charge, selected such that its self-ignition temperature T1 is less than that T2 of the main charge 16 for reasons to be explained. Examples of pyrotechnic materials which can be used in the present invention are given in application FR 2 870 234.

As indicated earlier, the gas generator 10 is intended to be mounted on a payload ejection device 22, and more particularly an ejection device 22 of the type illustrated in FIG. 1, comprising a main body 14 housing a piston 30 and a payload 40.

In the example, the gas generator 10 is mounted by its free end 12*b* on an axial end of the main body 14, such that the main body 14 of the ejection device 22 and the body 12 of the gas generator are located in the extension of each other.

The link between the free end of the body 12 of the gas generator 10 and the main body 14 of the ejection device 22 is shown in FIG. 1 by the line referenced 21.

It is evident that, in the present application, unless indicated otherwise, a radial direction is a direction perpendicular to the axis A and cutting this axis A. In addition, an axial direction is a direction parallel to the axis A. The adjectives axial and radial are used in reference to the abovementioned axial and radial directions. Similarly, an axial plane is a plane containing the axis A and a radial plan is a plan perpendicular to this axis.

Also, the upstream and the downstream are defined relative to the direction of displacement of the piston 30 and of the payload 40 along the axis A (from upstream to downstream).

In the example illustrated, the main body 14 is closed at its upstream end by a cover 26. At its periphery, the cover 26 is connected directly to the main body 14 by a weakened zone 24 adapted to break when the pressure applied to it reaches a predetermined adequate value P1.

When the gas generator 10 is mounted on the device to be actuated, the body 12 of the generator, the main body 14 of the device and the cover 26 delimit a combustion chamber 20 housing the primary pyrotechnic charge 16.

It is evident that, according to other embodiments, the cover can be omitted and the combustion chamber 20 can be delimited directly by the piston 30 of the ejection device.

As indicated previously, a series of firsts holes 50 is formed in the portion of the body 12 delimiting at least one part of the combustion chamber 20 along which the slide valve 60 slides (here the second section 52). These holes 50, which can be distributed over the entire periphery of the body 12, constitute a flow channel for flow of gases contained in the combustion chamber 20 outside said chamber.

During normal operation, the volume of the safety chamber 66, defined between the slide valve 60 and the body 12 of the gas generator 10, is minimum. The slide valve 60 stops against the second shoulder 55 of the body 12. In this position, the groove 70 does not communicate with the gas discharge holes 50 of the body 12 and the slide valve 60 totally blocks these holes 50. The combustion chamber 20 is closed.

When the pyrotechnic initiator 18 ignites the main charge 16, when the latter burns it releases gas. In the absence of a gas flow channel 50, the pressure inside the combustion chamber 20 rises very rapidly, as far as a value P1 at which the weakened zone 24 breaks and the cover 26 is detached from the body 14. Under the effect of pressure, the piston 30 is suddenly set in motion, in its course ejecting the payload 40.

In the different case of progressive elevation in temperature and in particular in case of fire, the temperature of the gas generator 10 rises progressively to reach a threshold temperature T1 corresponding to the self-ignition temperature of the pyrotechnic material 74. As indicated earlier, this temperature is evidently selected less than that T2 of the primary pyrotechnic charge.

Under the effect of its combustion, the pyrotechnic material 74 emits gases which boost the pressure inside the safety chamber 66.

Figure 2:
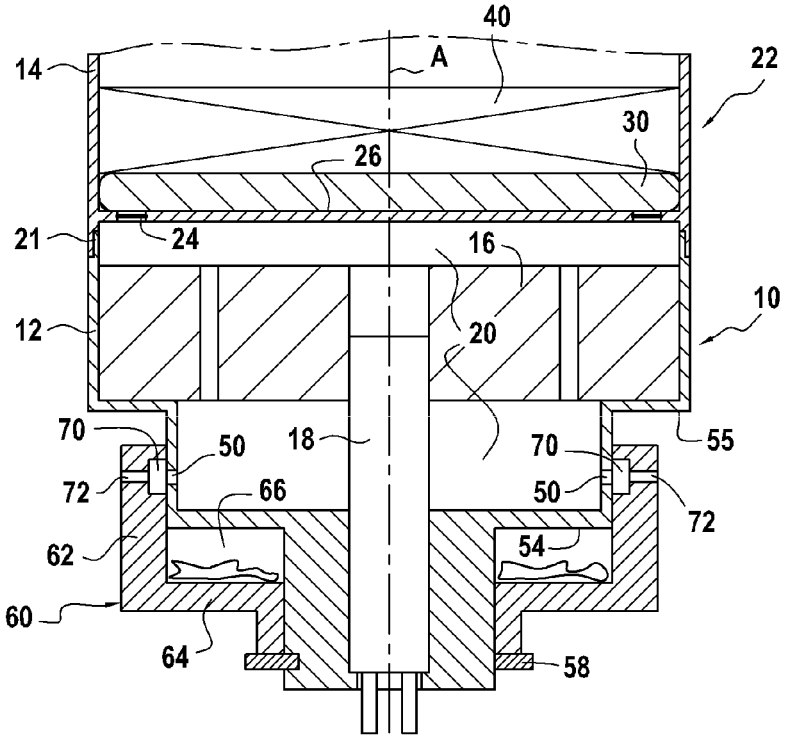
FIG. 2 shows the gas generator of FIG. 1, after abnormal heating.

The pressure of gas inside the safety chamber 66 tends to increase the volume of said chamber 66 and, for this, stresses the slide valve 60 away from the body 12. A stop 58 limits the course of the slide valve 12 to a second limited position illustrated in FIG. 2.

In this position, the groove 70 faces the gas discharge holes 50 formed in the body 12 of the actuator 10. By way of these discharge holes 50, the groove 70 and escape holes 72 formed in the slide valve 60, the combustion chamber 20 is in fluid communication with the external environment.

Two cases may be envisaged: either the temperature reaches the self-ignition temperature T2 of the main charge 16, and in this case the main charge 16 is ignited, releasing gases in the combustion chamber 20, or the temperature fails to reach the self-ignition temperature T2 of the main charge 16 (for example because the fire is extinguished in time).

In the first case in point, some of the gases escape to the exterior via the flow channel 50. This flow channel 50 is dimensioned such that the pressure inside the combustion chamber 20 cannot reach the value P1, which is that for which the piston is moved. In this way, in the event of fire the weakened zone 24 remains intact, the cover 26 remains in place, and the piston 30 is not moved. People located near the actuator 10 are not placed in danger by the unannounced ejection of the payload 40, and said charge 40 is kept for later use.

In the second case in point, the primary pyrotechnic charge 16 does not ignite. It remains intact and the device to be actuated remains at rest. Only the pyrotechnic material 74 contained in the safety chamber 66 has burnt and should be replaced.

The invention claimed is:

1. A gas generator comprising:

a body delimiting at least a part of a combustion chamber, said part housing a primary pyrotechnic charge adapted to generate gases in the combustion chamber when said charge is initiated in combustion, and a slide valve located outside said body and defining with the latter a second chamber housing a secondary pyrotechnic charge whereof the self-ignition temperature is less than that of the primary pyrotechnic charge, wherein a gas flow channel for flowing gas out of the combustion chamber is formed in the body, wherein the slide valve blocks the gas flow channel when it is in a first position, and wherein, under the effect of gases released by said secondary pyrotechnic charge, the slide valve is adapted to move to a second position wherein said channel is no longer blocked, allowing gases contained in the combustion chamber to flow outwards to the exterior.

2. The gas generator according to claim 1, wherein the slide valve is capable of moving by sliding as per a rectilinear trajectory.

3. The gas generator according to claim 1, wherein the gas flow channel comprises a plurality of holes distributed over the circumference of the body.

4. The gas generator according to claim 1, wherein the slide valve comprises at least one opening adapted to communicate with the flow channel for the gas when the slide valve is in its second position, the gas contained in the combustion chamber then able to flow towards the exterior through said flow channel and said opening.

5. The gas generator according to claim 4, wherein the opening comprises a circumferential groove formed on the internal face of the slide valve and at least one hole terminating in said groove and on the external face of said slide valve, said groove delimiting an annular chamber with the body when the slide valve is in its first position and being adapted to communicate with the gas flow channel when the slide valve is in its second position.

6. The gas generator according to claim 4, wherein the gas flow channel comprises a circumferential groove formed on the external face of the body and at least one hole terminating in said groove and on the internal face of said body, said groove delimiting an annular chamber with the slide valve when the latter is in its first position and being adapted to communicate with its opening when the slide valve is in its second position.

7. The gas generator according to claim 1, wherein the slide valve is coaxial to the body.

8. The gas generator according to claim 1, wherein the body comprises at least one first section having a first diameter and a second section of greater diameter located in the extension of the first section, a shoulder being defined between the first and the second section, and wherein the slide valve comprises a first part adapted to slide along the second section and a second part extending radially towards the interior and whereof the internal radial face is adapted to slide along the first section, the second chamber (68) being defined between the shoulder and the second part of the slide valve.

9. A device to be actuated comprising a gas generator according to claim 1, wherein the gases emitted by the primary pyrotechnic charge of the gas generator when it is initiated in combustion are adapted to actuate said device.

10. The device to be actuated according to claim 9, comprising a payload ejection device.

11. The device to be actuated according to claim 9, comprising a cylinder.

* * * * *